US005321376A

United States Patent [19]

MacLean

[11] Patent Number: 5,321,376

[45] Date of Patent: Jun. 14, 1994

[54] TAGGING RELAY

[75] Inventor: Alexander MacLean, Hingham, Mass.

[73] Assignee: Electro Switch Corp., Weymouth, Mass.

[21] Appl. No.: 946,947

[22] Filed: Sep. 17, 1992

[51] Int. Cl.[5] ..... H01H 73/12

[52] U.S. Cl. ..... 335/17; 335/190

[58] Field of Search ..... 335/185-190, 335/17

[56] References Cited

U.S. PATENT DOCUMENTS 4,133,020 1/1979 MacLean .
4,137,439 1/1979 MacLean .
4,255,733 3/1981 MacLean .
4,301,433 11/1981 Castonguay et al. ..... 335/17
4,507,641 3/1985 Poth ..... 335/189

*Primary Examiner*—Lincoln Donovan
*Attorney, Agent, or Firm*—Wolf, Greenfield & Sacks

[57] ABSTRACT

A tagging relay is designed to provide for remote, central control of electrical distribution lines and their respective breaker coils, such control formerly being manually effected only. The relay has a switch shaft construction rotatable from a first, "closed" position to a second, "open" position, from the second position to a third, "tagged" position, from the third to the second position, or from the second to the first position. The rotation can be effected manually via a handle, or remotely via electrical input to one or more solenoids. The relay is designed and constructed such that actuation of any one solenoid may effect rotation of the switch shaft construction to one of the three positions, exclusively. The switch shaft construction is operably linked to a contact-carrying rotary switch shaft provided within a conventional, stationary contact-carrying switch body. The switch body is addressable by wires and may be arranged such that when the relay is switched to any of the first, second, or third positions, a particular signal is transmitted from the relay to a remote location, indicating such positional status, and/or energizing or de-energizing a particular power line or breaker coil. The switch body may also be wired and arranged such that particular incoming signals from a remote location may effect particular switching changes among and between the first, second, and third positions.

27 Claims, 13 Drawing Sheets

TAGGING RELAY

FIELD OF THE INVENTION

This invention is in the field of electrical power switches used to control power company distribution power lines. A 3-position relay serves to designate a particular line as "open", "closed", or "tagged", and allows the line to be remotely operated.

BACKGROUND OF THE INVENTION

In the electrical power industry, long distance distribution control lines are connected to breaker coils, which may be commanded to open or close the power line for a variety of reasons. For example, a power surge or other mishap may trip a coil, opening a line, or a breaker may be opened so that a line may be serviced. Breakers may also be opened or closed so that power transmission may be routed in one way or another to satisfy a particular geographic power demand and/or so that power may be transmitted in accordance with demand in the most efficient way possible. Additionally, in many fields in which transmission of heavy power loads is requisite, particular lines may be routinely opened or closed.

Traditionally, manual control switches have been used to operate circuit breakers which in turn may energize or de energize power lines and/or electrical equipment. For safety reasons, strict rules universal to the industry have been followed with respect to manual operation of such switches. Specifically, when a manual control switch controlling a breaker is opened, an orange tag with the operator's initials printed thereon is attached to the manual switch, and that particular operator alone may close the switch to allow the circuit breaker to re energize the line. This paper tag system has been very effective, as manual and local control of electrical power systems has, up until now, been the norm.

However, a trend currently exists in the electrical power industry toward central control of entire power systems, with many of the formally local, regional control functions being automated and controlled remotely from distant, central locations. For example, automatic sensing assemblies which may sense instantaneous power distributions may transmit information to a central location, where a decision may be made to re-route certain distribution pathways so as to meet a particular demand or create more efficient transmission or distribution. The decisions and actions taken with respect to routing at a central location may be made by personnel, or, increasingly, a power system central computer may control many of these operations. In the power industry, such central control by computer is commonly termed SUPERVISORY CONTROL AND DATA ACQUISITION, or SCADA. A particular SCADA system may be equipped to receive signals from remote locations containing information regarding the status of damaged or recently repaired lines, of power demands, or of current routes of distribution, may make decisions regarding a desirable status of a particular line, and may transmit signals that may close or open a particular switch to allow a particular breaker to close, or to prevent its closure.

Therefore, a need exists in the industry for a system which allows remote application of visual tagging to local manual control switches or to local control switches which have become automated, for example, under the control of system such as SCADA.

SUMMARY OF THE INVENTION

It is an object of this invention to provide a means and a method of opening and closing a power circuit or a power circuit control through a tagging relay having a first position in which a circuit is energized, and an alternate position in which a circuit is de energized and a tag carrying a written message is visibly in position to visually indicate to the user a tagged de energized position of the relay. In the method, an electric circuit is used to remotely operate the relay or the relay may be manually actuated, either procedure causing a shaft construction to move a rotary switch from a first to an alternate position or vice versa.

It is another object of the invention to provide a tagging relay having first and second solenoids, which may be rotary solenoids, constructed and arranged to actuate rotary movement of a shaft construction in a switch shaft construction embodiment to a first or second position, the switch shaft construction having a cam arrangement carried by a detent construction for locking the switch shaft construction in the first or alternate position while permitting reciprocal rotation to either position by operation of at least one solenoid. Generally, at least one of the positions is indicated by a tag carrying a verbal message operably linked to the shaft construction for rotation therewith into and out of a visible position.

It is another object of this invention to provide, separately or in combination with the features described above, a tag assembly for use with an electrical power line switch to indicate an open o energized power line position comprising a switch shaft carrying a tag member comprising a printed message being spring biased between front and rear walls to allow rotation therebetween, one of the walls containing an opening in which the printed message is visible in one position of the rotary shaft and tag member.

It is another object of the present invention to provide a method of opening and closing a power circuit through a tagging relay having three positions corresponding to energized, de energized, and de-energized tagged positions, respectively. It is a feature of the method that the relay may be switched remotely using a solenoid to bring the switch to one of the positions, or manually by use of a handle. Generally, more than one and preferably three solenoids are provided in the remote operation, each solenoid effecting rotation of the switch shaft construction to one of the three positions, by way of solenoid actuating members which interact with switch shaft crank members, and a switch shaft cam arrangement which interacts with a detent construction.

It is a feature of the present invention that a switch shaft construction, cam arrangement, and detent construction may be designed and constructed such that actuation of a solenoid may rotate a switch shaft through a partial axial rotation only toward a particular position, and that after such partial rotation toward a particular position, the remainder of the rotation to the desired position may be effected by a force exerted by a resilient member attached to the detent construction which, in combination with the cam arrangement, completes the rotation to the desired position.

It is another feature of the present invention that the switch shaft construction may be operably linked to a contact carrying rotary switch shaft which comprises a plurality of stages, each stage comprising stationery electrical contacts and electrical contacts rotatable with the shaft, the stages being addressable by a plurality of input wires and arranged such that a particular input signal may effect solenoid actuation to rotate the switch shaft construction through a rotation toward a particular position.

It is still another object of the present invention to provide an output signal assembly working in conjunction with the contact carrying rotary switch shaft construction to allow transmission of a signal from a tagging relay, the signal being specific to a first, a second, or a third position of the tagging relay, and controlling operation of a power line, especially a distribution line breaker based on the tagging relay position, possibly from a central control such as SCADA.

It is another feature of the present invention that, using the manual control, the tagging relay may be switched from a tagged position to an open position from the open position to a closed position, from the closed position to the open position, or from the open position to the tagged position, exclusively.

It is another feature of the present invention that, in the remote operation mode, the above noted position changes, exclusively, may be made.

It is another feature of the present invention that, when a solenoid is actuated to effect rotation of the switch shaft construction from any first position to any second position, the solenoid need not remain actuated to hold the switch shaft construction in the second position, but need only rotate the switch shaft construction from the first position toward the second position to an intermediate position, and then may cease functioning as the detent construction and cam arrangement advantageously complete the rotation and hold the relay in the second position. That is, in any of a first, second, or third position of a tagging relay the relay is held firmly in the desired position without electrical energy being applied thereto.

It is another feature in the present invention that a rugged tagging relay is providing, which tagging relay may be switched from position to position tens of thousands of times without failure, which tagging relay is constructed and arranged to firmly hold the switch shaft construction in any one of the three positions during excessive vibration or shock, and is constructed and arranged to function well after withstanding such excessive vibration or shock.

It is still another feature of the present invention that a two position tagging relay, operable remotely and/or manually is provided by the present invention, as well as a three-position tagging relay operable manually and/or remotely. According to the present invention, the control electrical circuit may be wired in any number of ways, such that one or more of the above described solenoids is operable or inoperable remotely, allowing a variety of remotely controllable relay arrangements.

BRIEF DESCRIPTION OF THE DRAWINGS

The above and other features, objects and advantages of the present invention will be better understood from the following specification when read in conjunction with the accompanying drawings, some of which are semidiagrammatic, in which.

DESCRIPTION OF PREFERRED EMBODIMENTS

Figure 1:
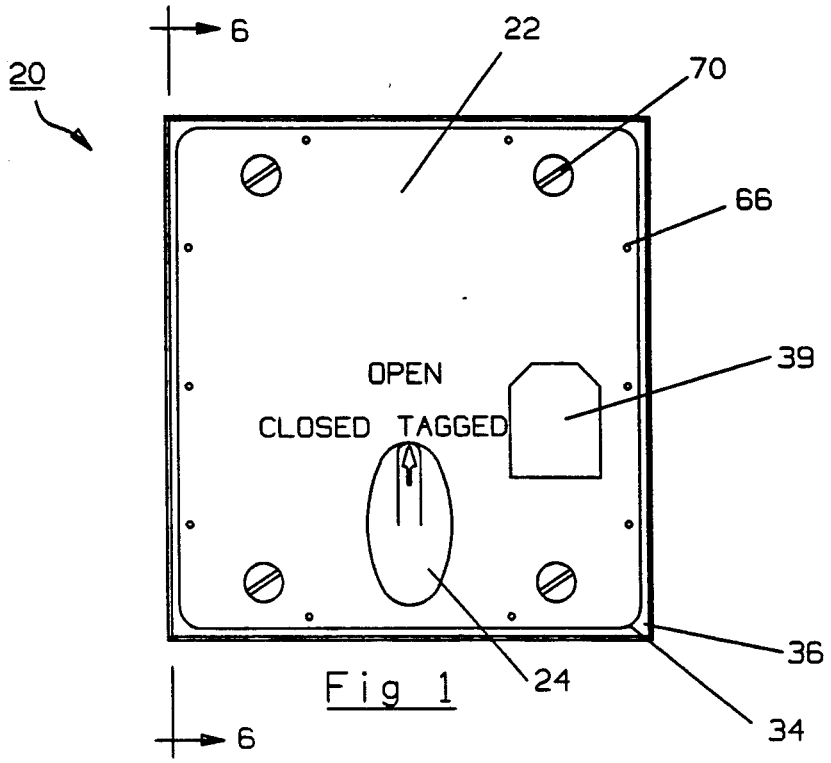
FIG. 1 is a front view of a tagging relay in accordance with a preferred embodiment of the present invention.
Figure 2:
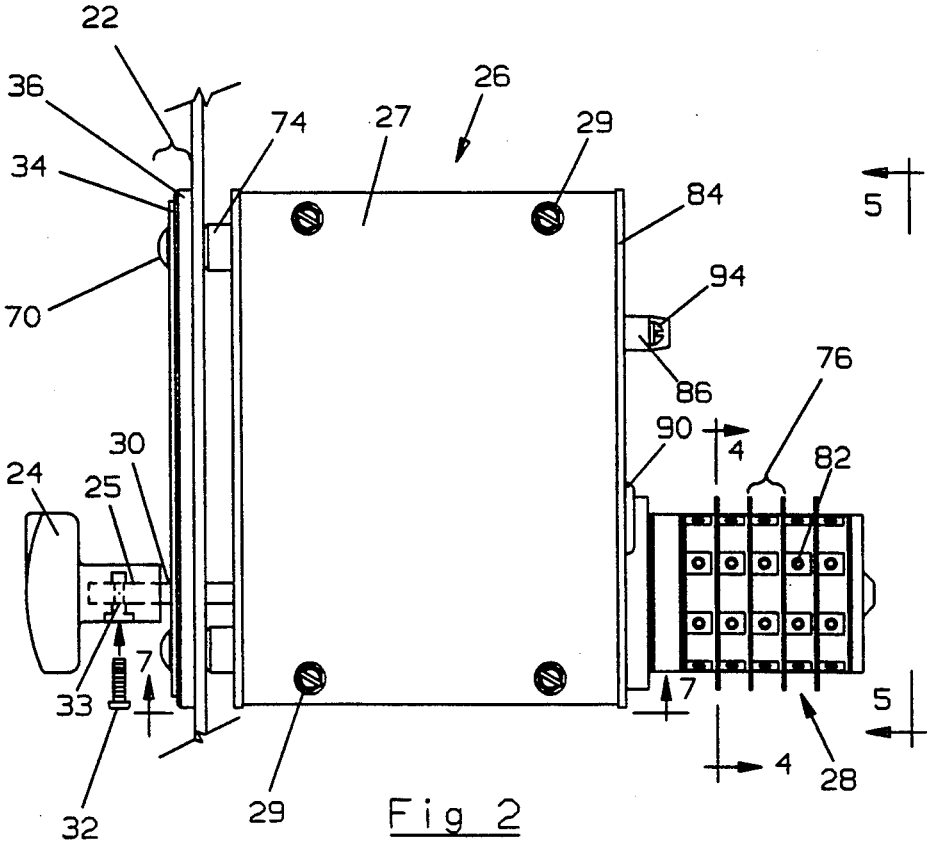
FIG. 2 is a side view thereof.

Referring now to FIGS. 1 and 2, a tagging relay in accordance with a preferred embodiment of the present invention is illustrated generally at 20, and includes tag assembly 22, handle 24, relay construction 26 covered by side cover plate 27 which is fastened with screws 29, and conventional cylindrical rotary switch body 28. In all the accompanying figures, elements of the present invention common to several figures are represented by common numerical designations.

Handle 24 is sized conveniently to facilitate manual control of tagging relay 20 and is constructed of conventional metal or plastic materials known in the industry such as molded phenolic. Handle shaft 30 fits into shaft hole 25 in handle 24, handle 24 being attached to handle shaft 30 using any conventional means. Preferably, handle screw 32 screws into threaded hole 33 in shaft 30 to facilitate attachment and axial rotation of the shaft along with the handle. Shaft 30 and shaft hole 25 in handle 24 may be circular or any shape desired. Preferably, shaft 30 and shaft hole 25 are both non circular in cross section such that more secure attachment is facilitated. In the preferred embodiment, shaft 30 is square and fits into mating square hole 25 in handle 24, and in combination with screw 32, secure attachment is made.

Figure 3A:
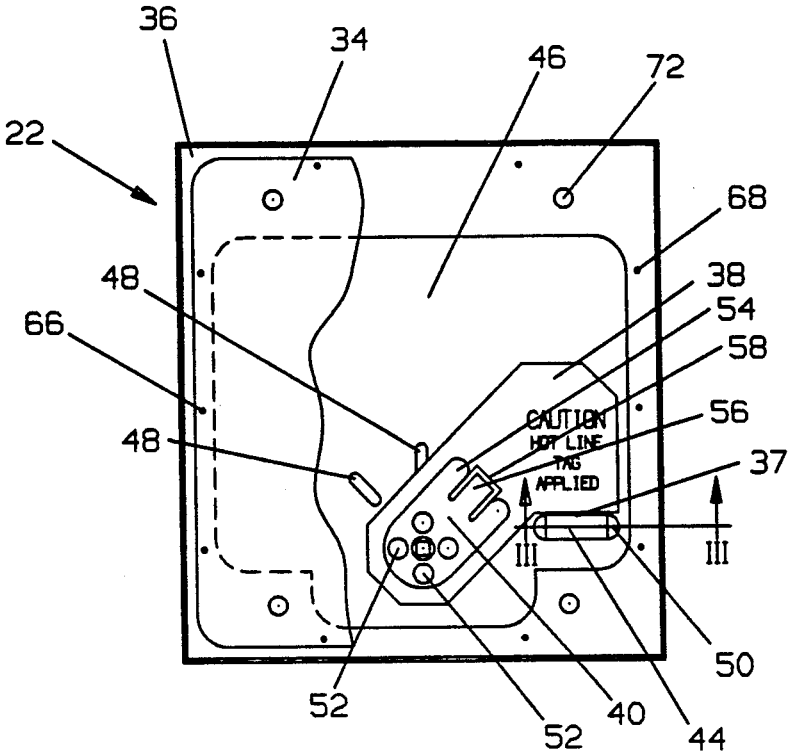
FIG. 3*a* is a cutaway view of a tag assembly in accordance with a preferred embodiment of the present invention.
Figure 3B:
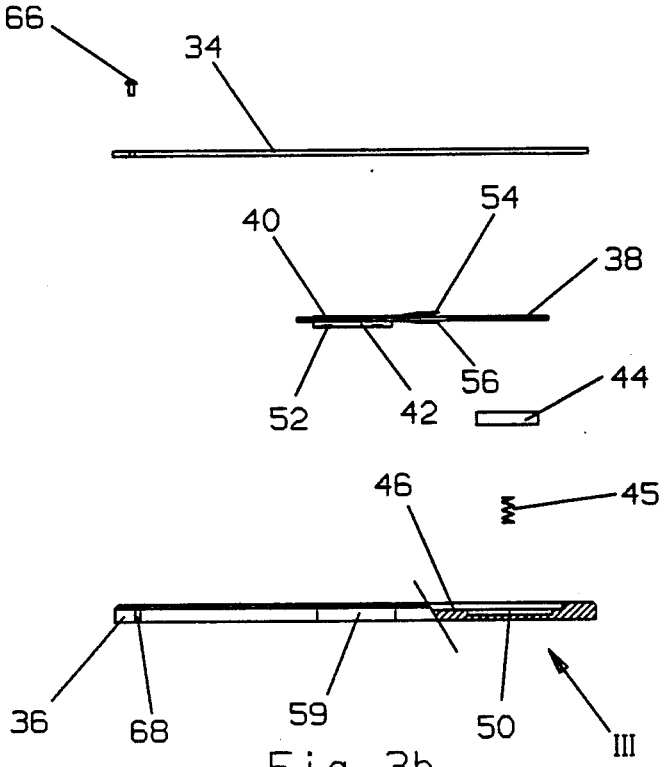
FIG. 3*b* is an expanded, bottom view thereof.

Tag assembly 22, mounted in front of relay construction 26 in the preferred relay, may function in other combinations but preferably is operably linked to relay construction 26. Referring now to FIGS. 3*a* and 3*b*, a cutaway front view of assembly 22 and an expanded bottom view thereof, respectively, are illustrated in detail. In FIG. 3*b*, region A is a cutaway of rear wall 36 taken through line A—A of FIG. 3*a*. Assembly 22 comprises a planar front wall 34 and planar rear wall 36, with substantially planar tag member 38, leaf spring member 40, circular hub 42, and impact stop bar 44 sandwiched therebetween. Front and rear walls 34 and 36 may be substantially flat and may include a border spacer sandwiched therebetween to create an open, inter wall region for operation of tag member 38 and related component instead of region 46 which is described below. Preferably, front wall 34 is a substantially flat, thin construction of any rigid material, preferably metal alloy, and has the words "closed", "open", and "tagged" printed thereon corresponding to the respective positions of relay 20 and corresponding positions of handle 24. Rear wall 36 is generally constructed of material similar to that of front wall 34, but is preferably thicker, generally from about 1/16 inch to about ⅜ inch thick, preferably about 3/16 inch thick, and has a region 46 machined therein so as to create space for tag member 38 and related components when front wall 34 is placed against rear wall 36.

Region 46 is preferably machined into rear wall 36 to a depth of approximately 1/16 to ⅛ inch, and includes spring detent indentations 48 and impact stop bar indentation 50 machined therein to an additional depth of from about 1/32 to about ⅛ inch. Tag member 38, fabricated from any reasonably stiff material, and preferably 1/32 inch thick fabric based phenolic, is desirably of a color indicating a particular warning or message, and/or has a warning message printed thereon. Preferably, tag member 38 is orange with black lettering printed thereon reading "CAUTION HOT LINE TAG APPLIED", to comply with warning standards in the electrical power industry, especially power distribution, and is visible through window 39 of front wall 34 when relay 20 is in the "tagged" position.

Spring member 40, fabricated from any thin, resilient metal or alloy, and hub 42, designed to mate with shaft 30 and having an appropriately shaped hole therein, sandwich tag member 38. Spring member 40, tag member 38 and hub 42 are fastened together by any means such as rivets 52 which pass through spring member 40, tag member 38, and hub 42. Spring member 40 includes forward spring fingers 54 and rearward spring finger 56, designed to press against and ride along front wall 34 and rear wall 36, respectively, to assure that tag member 38 travels smoothly therebetween. Rearward spring finger 56 protrudes rearwardly from tag member 38 through cutout 58 in the tag member.

Preferably, spring member 40 is constructed, as shown, with a 2-to-1 ratio of forward spring fingers 54 to rearward spring finger 56 such that tag member 38 rides almost against rear wall 36 rather than front wall 34 to prevent the possibility of scratching or other abrasion of the frontward facing, visible warning carrying tag member 38 if the tag member is displaced slightly in normal use.

Hub opening 59 in rear wall 36 receives hub 42 and allows it to rotate therein with sufficient, but not excessive play. Thus, a tag member 38 travels in a radial rotational path about hub 42, securely mated with shaft 30 such that tag member 38 and its visible, printed and/or colored warning is properly positioned within window 39 when the assembly is in the tagged position.

Impact stop bar 44, generally fabricated from stiff, yet resilient material such as nylon or other plastic, is desirably mounted via coil spring 45 in impact stop bar indentation 50, so as to assure that tag member 38 is accurately framed within window 39 when relay 20 is in the tagged position. Thus there is a lower flat edge 37 that is stopped substantially in exact desired position in registration with window 39, by stop bar 44 in the tagged position. Additionally, rearward spring finger 56 is designed to expand into spring detent indentations 48 in each of the "closed", "open" and "tagged" positions so that tag member 38 is properly positioned according to each position.

Front wall 34 may be securely fastened to rear wall 36 by any means such as drive screws 66 in holes 68. Screws 70 pass through holes 72 in front and rear walls 34 and 36 and fasten to threaded spacers 74 in an exemplary means of mounting tag assembly 22 to relay construction 26. With screws 70 in position, screws 66 or other means of fastening front wall 34 to rear wall 36 are not strictly necessary.

Tagging relay 20 is designed and constructed to allow switching between a tagged position and at least one alternate position. In the preferred embodiment illustrated in FIG. 1, three positions are provided: "closed", "open" and "tagged". Shaft 30, actuated manually by handle 24 or, alternately, remotely as described below, rotates the relay and tag assembly to and between these positions. Relay 20 may be designed and constructed such that the "closed", "open", and "tagged" positions, or "tagged" and at least one alternate position exist at any desirable rotational position. Preferably, the "tagged" and nearest alternate position are rotationally spaced such that when the relay is switched out of the tagged position, no portion of tag member 38 is visible through window 39. Additionally, the "tagged" position and alternate position (in a two position relay), or the "tagged", "open" and "closed" positions in a three-position relay are spaced apart rotationally such that secure retention in any of the three positions via relay construction 26, and accurate switching to any of the two or three positions remotely via relay construction 26, described below, is achievable. In the preferred, three-position relay illustrated in FIG. 1, handle 24 points directly upward when the relay is in the "open" position, is rotated approximately 45° clockwise when the relay is in the "tagged" position, and is rotated approximately 45° counterclockwise when the relay is in the "closed" position. Preferably "closed" is an electrical power energized position while "open" and "tagged" are power de energized positions of the power distribution control circuit controlled by the tagging relay.

Figure 4A:
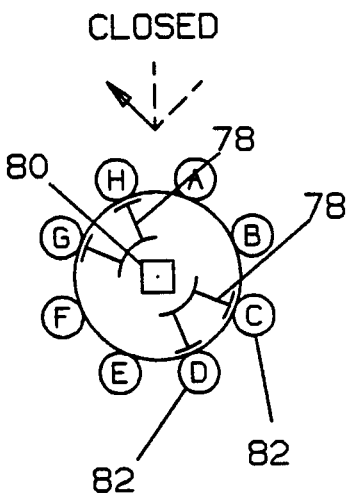
FIGS. 4*a–c* are a semidiagrammatic cross-sectional view through line 4—4 of FIG. 2 illustrating electrical contacts in three rotational positions.
Figure 4B:
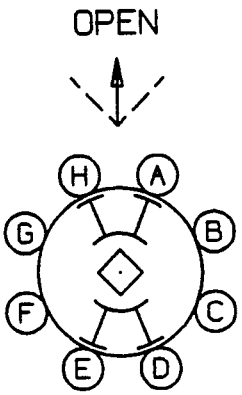
Figure 4C:
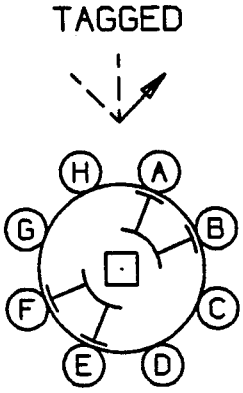

Referring now to FIGS. 2 and 4*a–c*, a preferred relationship between handle 24 and conventional rotary switch body 28 is described. Switch body 28 may comprise any known rotary relay switch comprising an electrical contact carrying rotary switch shaft 80 and a plurality of stationary electrical contacts. The rotary switch shaft 80 is operably linked to shaft 30 and is effectively an integral shaft therewith in the preferred embodiment so that when either shaft 80 or shaft 30 rotates, both shafts turn through the same degree and direction of rotation. A preferred embodiment of switch body 28 is described in U.S. Pat. No. 4,255,733, incorporated herein by reference. Conventional switch body 28 may comprise any number of stages 76, the number of stages being generally equal to or greater than the total number required to receive the number of electrical signals necessary to actuate a desirable number of rotational operations remotely, described below, together with the number needed to transmit a desired number of electrical signals based upon the positions of the relay. That is, switch body 28, stages 76, and circuitry that addresses stages 76, described below, may be tailored to achieve a variety of tagging relay functions. FIGS. 4*a–c* are a cross-sectional views taken through line 4—4 of FIG. 2 to illustrate, by way of example, the preferred relationship between any particular stage 76 and operating positions of handle 24 and shaft 30.

Referring to FIGS. 4*a–c* movable electrical contact members 78 are rotated by electrical contact rotary switch shaft 80, operably linked to shaft 30 and handle 24 in the preferred embodiment. Members 78 make and break contact with stationary electrical contacts 82 when rotated to the "closed", "open" and "tagged" positions. Movable contact member 78 may be designed and constructed to electrically connect a plurality of stationary contacts 82 in one or plural parallel stages 76 depending upon the rotational position of shaft 80. In the preferred embodiment two radially opposed movable members 78 each connect two adjacent stationary contacts 82 in each stage, different pairs of stationary contacts 82 being electrically connected at each of three rotary positions of shaft 80 corresponding to a "closed", "open" and "tagged" position of the relay. It can be seen from FIGS. 4*a–c* and the accompanying description that one skilled in the art could make any desirable electrical connections based on the connections of stationary contacts 82 at each of the "closed", "open" and "tagged" positions, to signal to a remote location such "closed", "open", or "tagged" status of relay 20 and/or actuate computer control or other activity via, for example, SCADA, as noted above.

Figure 5:
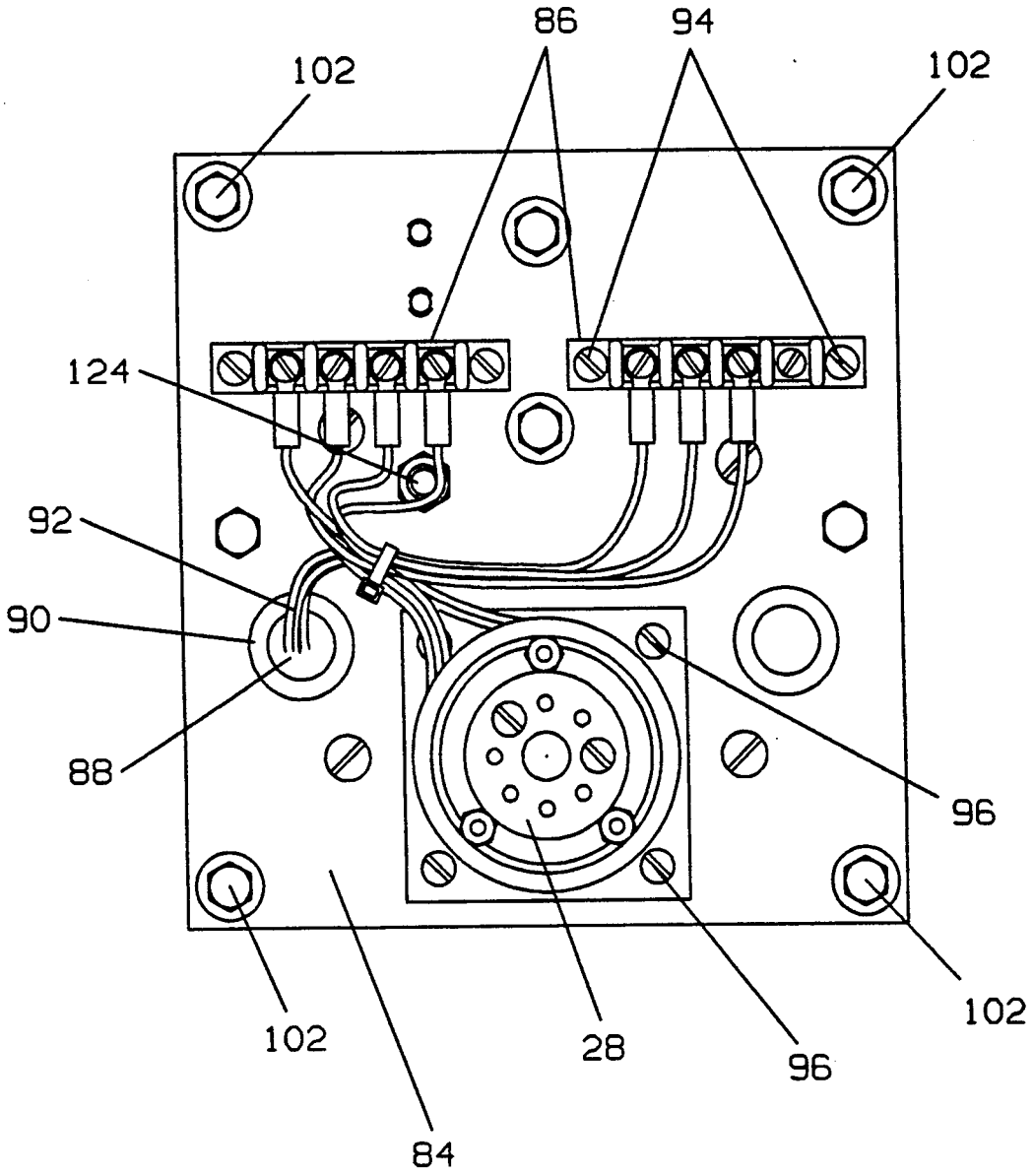
FIG. 5 is a rear view of the embodiment illustrated in FIGS. 1 and 2 in the direction of arrows 5—5.

Referring now to FIG. 5, a rear view of tagging relay 20 is illustrated, showing rear structural plate 84 and having remote conventional terminal blocks 86 mounted thereon. Terminal blocks 86 are addressable by electrical contacts carrying communication between tagging relay 20 and a remote central control such as SCADA, described above. Blocks 86 may comprise any number of terminals, and comprise eight terminals in the embodiment illustrated in FIG. 5, the terminals generally being connected to electrical contacts on stages 76 of switch bodies 28 and/or to circuitry internal to relay construction 26, through electrical access port 88. Any number of access ports 88 may exist as a simple hole in rear cove plate 84. Preferably, access 88 comprises a hole that is bordered by a rubber grommet 90 designed to prevent damage to insulation on wires 92 and serve as additional electrical insulation from rear cover plate 84 when the plate comprises steel or other conductive metal. Terminal blocks 86 may be fastened to rear plate 84 using any securing means such as screws 94, threaded into holes in plate 84. Similarly, switch body 28 may be fastened securely to rear plate 84 with means such as screws 96 threaded directly into plate 84.

Figure 6:
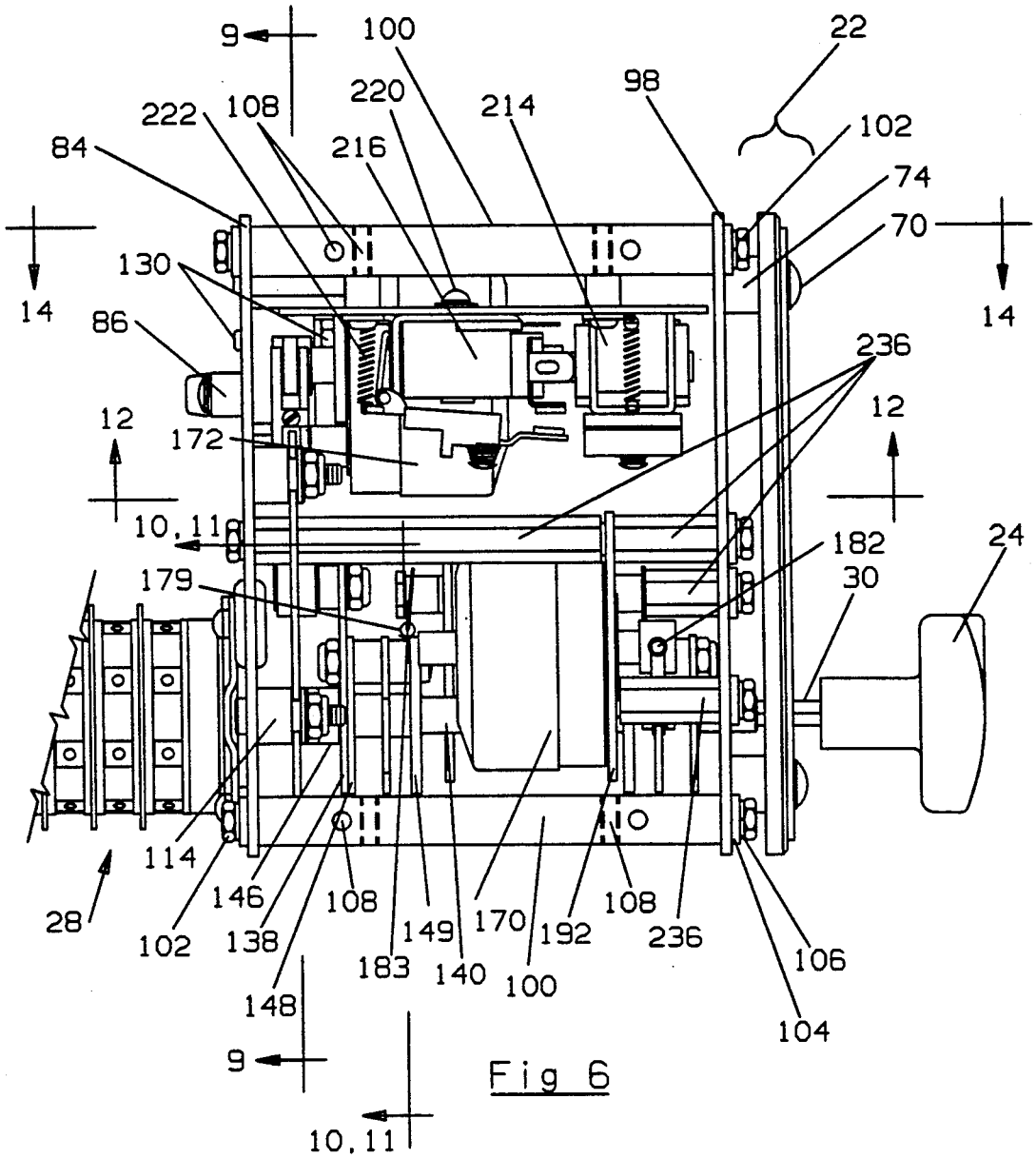
FIG. 6 is a cross-sectional view taken through line 6—6 of FIG. 1.
Figure 7:
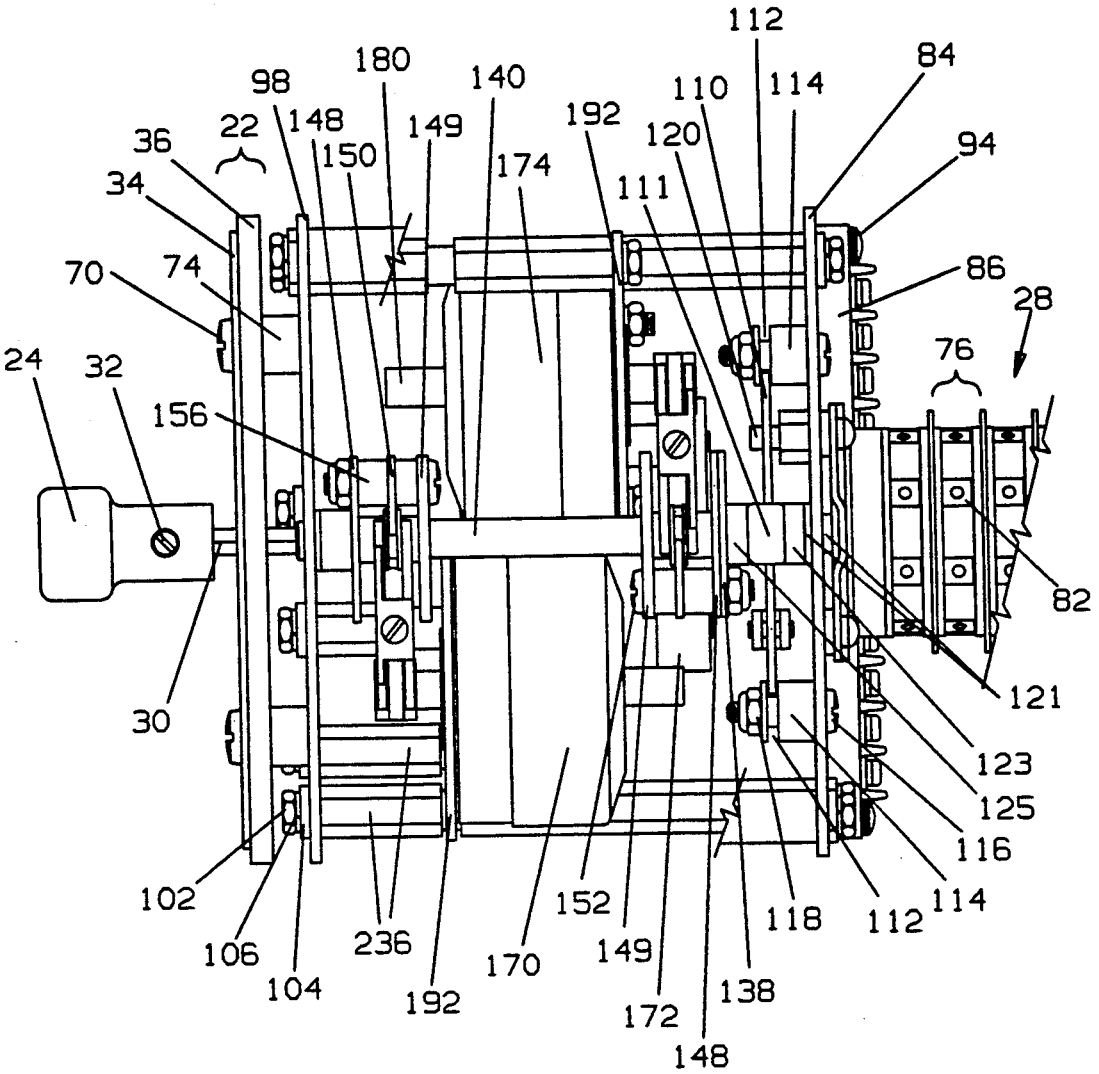
FIG. 7 is a cross sectional view taken through line 7—7 of FIG. 2.

Referring now to FIGS. 6 and 7, side and bottom views, respectively, of tagging relay 20 are illustrated with side and bottom cover plates removed to expose the internal components of relay construction 26. The size of relay construction 26 may vary depending upon the desired utility, and is generally dictated by the dimensions of front structural plate 98, rear structural plate 84, and structural corner beams 100. In the preferred embodiment, front and rear structural plates 98 and 84 are approximately 5⅜ inches wide by 5⅝ inches high, and corner beams 100 are approximately 4⅛ inches long, although, as noted above, these dimensions are not critical to the utility of the present invention. Front and rear structural plates 98 and 84 are fastened to the ends of corner beams 100 by screws 102 which thread into beams 100. Generally, washers 104 and lock washers 106 facilitate secure attachment at corner beam attachment and at other locations where structural elements attach to front and/or rear structural plates 84 and/or 98. Front and rear structural plates 98 and 84 and corner beams 100 are fabricated from any rigid structural material such as metal or metal alloy, and comprise steel in the preferred embodiment. Holes 108, threaded into beams 100, are designed to receive screws for attaching side, top, and bottom cover plates to beams 100 to complete the box like construction of relay construction 26.

"Closing" solenoid 170, "opening" solenoid 172, and "tagging" solenoid 174 are mounted within relay construction 26, preferably by way of solenoid mounting members 236, attached to front and/or rear structural walls 98 and/or 84 in a manner similar to that of structural members 100. Additionally, "closing" solenoid 170 and "tagging" solenoid 174 are provided with solenoid mounting plates 192, facilitating mounting in combination with mounting members 236.

Figure 9:
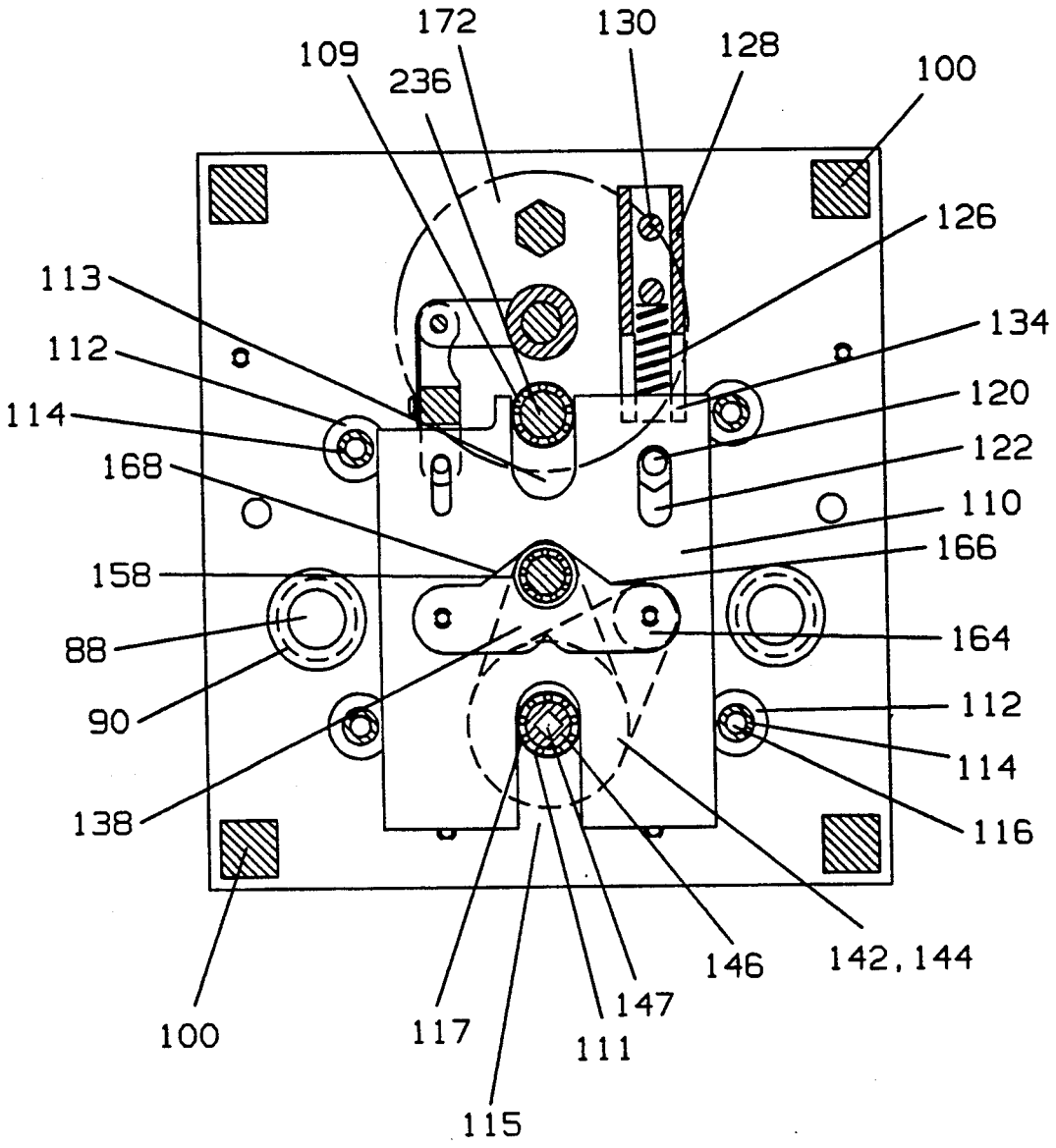
FIG. 9 is a cross sectional view taken through line 9—9 of FIG. 6, absent illustration of plate 218.

Referring now to FIG. 9 in conjunction with FIGS. 6 and 7, detent plate 110 is illustrated, mounted in slots 112 of detent plate mounting brackets 114. Mounting brackets 114 are fastened to rear structural plate 84 by means of screw 116, passing though bracket 114, and nut 118 (FIG. 7). Detent plate 110 is movable up and down, sliding within slots 112 of brackets 114, and about rollers 109 and 111 in detent plate slots 113 and 115, respectively. Roller 109 is mounted about a solenoid mounting member 236 and roller 111 is mounted about shaft 146. The limits of the up and down movement of detent plate 110 are restricted by stationary peg 120 fitting through slot 122 of movable detent plate 110. Peg 120 may be similarly fastened to rear structural plate 84 by means of nut and bolt combination 124 (FIG. 5). A downward force on detent plate 110 is exerted at all times by a resilient member such as spring 126 retained in housing 128. Housing 128 may be attached to rear structural wall 84 by way of bolts 130 which may thread directly into wall 84. The top edge of detent plate 110, where it impinges against spring 126, rides up and down in a slot 134 in housing 128, during up and down reciprocal movement of plate 110.

Figure 8:
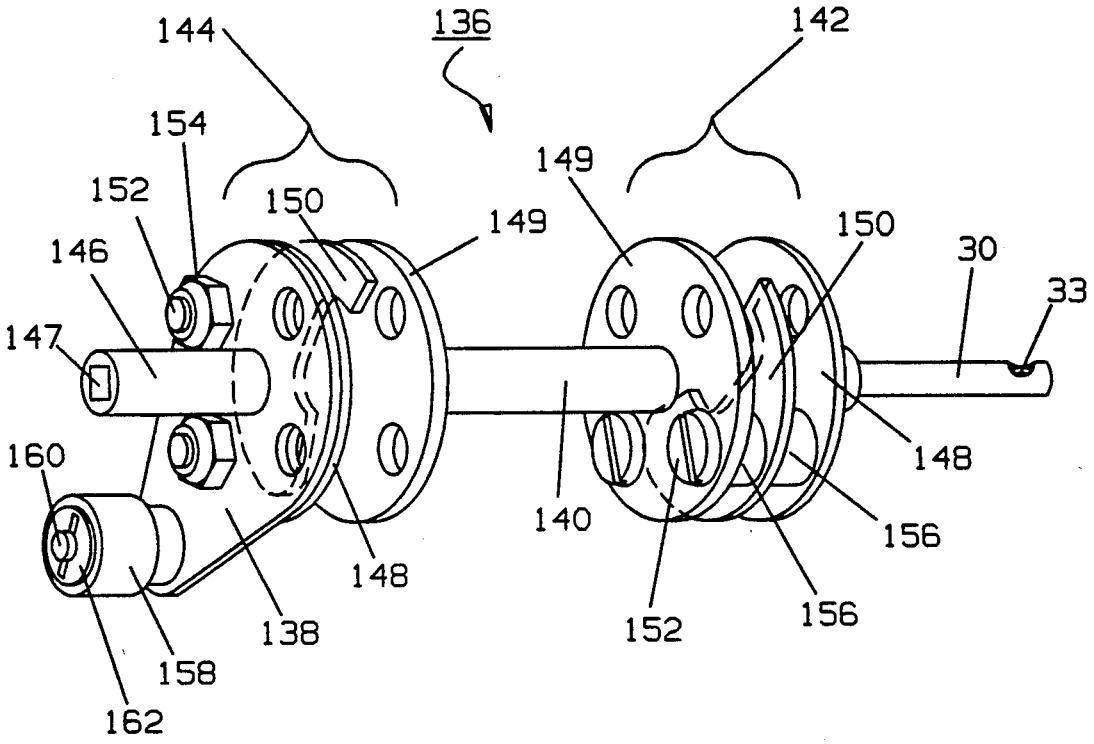
FIG. 8 is a three dimensional illustration of a switch shaft construction, including cam follower, in accordance with a preferred embodiment of the present invention.

Referring now to FIG. 8, in combination with FIGS. 6, 7 and 9, switch shaft construction 136 is illustrated, including cam member 138 attached thereto. Switch shaft construction 136 comprises a central shaft 140 attached to and passing between crank members 142 and 144. Rear shaft 146, operably linked to central shaft 140, is itself operably linked to contact-carrying rotary shaft 80 (FIG. 4) rotatable within switch body 28, shaft 80 fitting into hole 147. Not shown in FIG. 8, but illustrated in FIG. 7, are spacers 123 and 125 which are mounted about shaft 146 and sandwich roller 111, also mounted about shaft 146 on bearing 117 (See also FIG. 9). Also illustrated in FIG. 7 is nylon bearing 121 through which shaft 146 passes. Referring again to FIG. 8, outer circular brackets 148 and inner circular brackets 149 sandwich ramps 150. Bolts 152, fastened with nuts 154 pass through outer brackets 148, inner brackets 149, and spacers 156 directly sandwiching ramps 150, as illustrated, completing the crank member assembly.

Also bolted to outer bracket 148 of crank member 144 is cam member 138. Central shaft 140 may be attached to inner brackets 149 by conventional means, or inner brackets 149 and central shaft 140 may comprise one individual component, as is the case in the preferred embodiment. Attached to cam member 138 is cam roller or follower 158, by way of bolt 160 supporting bearing 162.

Referring specifically to FIG. 9, cam follower 158 is shown with the relay in the "open" position in the preferred relay embodiment, and ghost illustrations of cam member 138, crank members 142 and 144, and "opening" solenoid 172 are shown. During rotation of relay 20 from the "open" to the "tagged" position in the preferred embodiment, that is, clockwise rotation as viewed in FIG. 9, detent plate 110 is forced upwards against the force of spring 126 by the action of cam follower 158 against detent cam track surface 168 (comprising a hole or slot in detent plate 110 as illustrated in FIG. 9). As cam follower 158, rotated by switch shaft construction 136, passes an intermediate rotary position at location 166 of detent cam surface 168, the force of spring 126 downward on detent plate 110 aids the rotation, rather than opposing it. That is, once cam follower 158 passes location 166, the action of spring 126 on detent plate 110 is to urge cam follower 158 to ghost location 164 ("tagged" position in the preferred embodiment), and to securely lock it thereat. It can be seen that counterclockwise rotation of switch shaft construction 136, that is from the "open" to the "closed" position would operate identically, and could be illustrated as a mirror image of the action of cam follower 158 with cam member 138 in FIG. 9, and is not shown. In the preferred embodiment, the intermediate rotary position, that is, where cam follower 158 passes location 166, occurs at approximately 22½ degrees rotation of switch shaft construction 136 in either direction away from the "open" position.

Figure 10A:
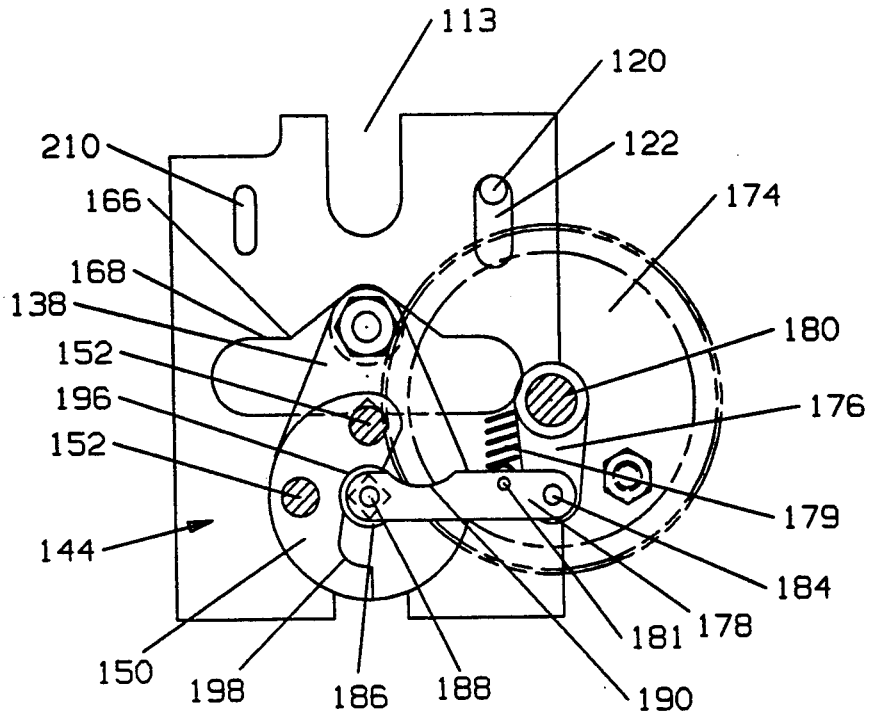
FIG. 10*a* is a cross sectional view of selected components taken through line 10—10 of FIG. 6.
Figure 10B:
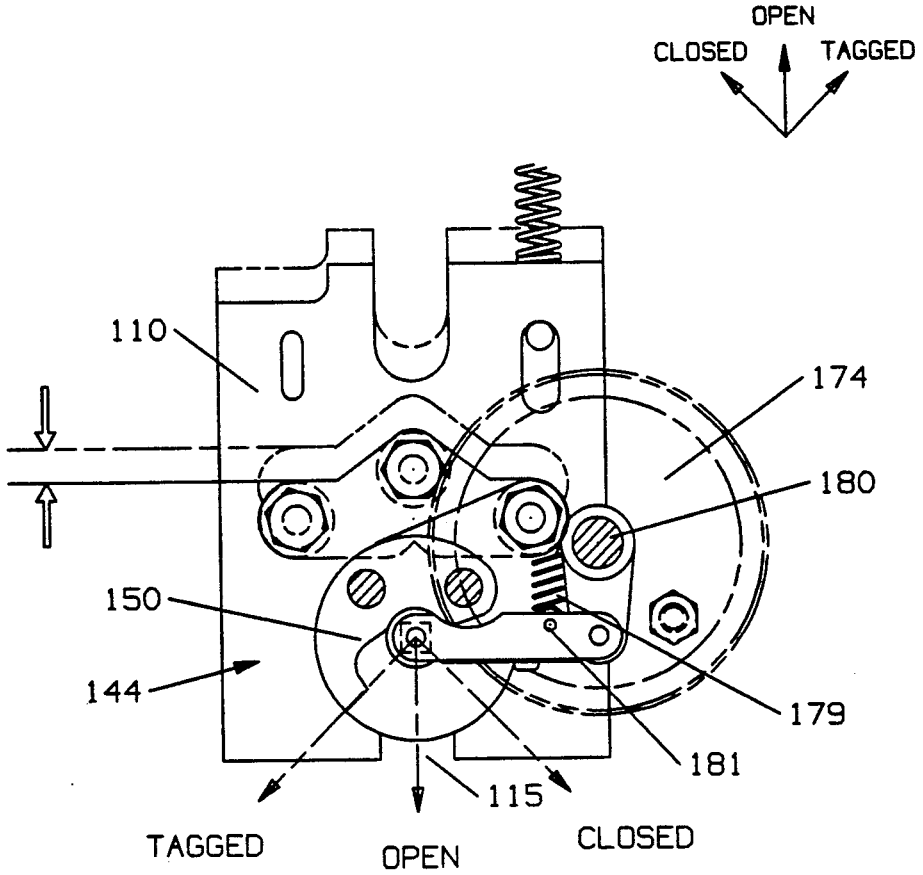
FIG. 10*b* is a cross sectional view of selected components taken through line 10—10 of FIG. 6.

Referring now to FIGS. 10*a* and 10*b*, a ghost illustration of "tagging" solenoid 174 is shown along with linkage means for driving crank member 144. Solenoid drive arm 176 is fixed and attached to solenoid shaft 180 for rotational movement therewith by way of pin 182 (FIG. 6). Solenoid drive arm 176 is rotatably attached to elongated plate, solenoid actuating member 178 by way of pin 184, passing through a slotted end of actuating member 178 and through drive arm 176. At the opposite end of actuating member 178 from the drive arm 176 is roller 186, mounted for rotation about a central axis perpendicular to plate 178 within another slotted end of member 178 and secured therein by way of pin 188. Member 178 is maintained in position so as to engage roller 186 with ramp 150 at all times by way of spring 179, stretching from pin 181 in a slotted portion of member 178 to an extension 183 from solenoid 174 (FIG. 6 in which solenoid 174 is hidden). Shaft 180, drive arm 176, and actuating member 178 are fabricated from rigid material such as metal alloy, and preferably steel. Roller 186 is fabricated from a durable material such as case hardened steel in the preferred embodiment. Indentation 190 is machined into actuating plate member 178 to allow free rotation of crank members 142 and 144 of switch shaft construction 13*b*, independently from and unobstructed by all solenoid linkage such as actuating member 178. As switch shaft construction 136 is manually (for example, by way of handle 24) rotated from the "open" position, as illustrated in FIG. 10*a*, to the "tagged" position, as illustrated in FIG. 10*b*, crank member 144, and particularly ramp 150 rotates clockwise and is unobstructed by actuating member 178 due to indentation 190. "Closing" solenoid 170 and related linkage interacts with crank member 142 in a manner identical to that illustrated in FIGS. 10*a* and 10*b* during rotation from the "open" position to the "closed" position, and is not illustrated.

Figure 11:
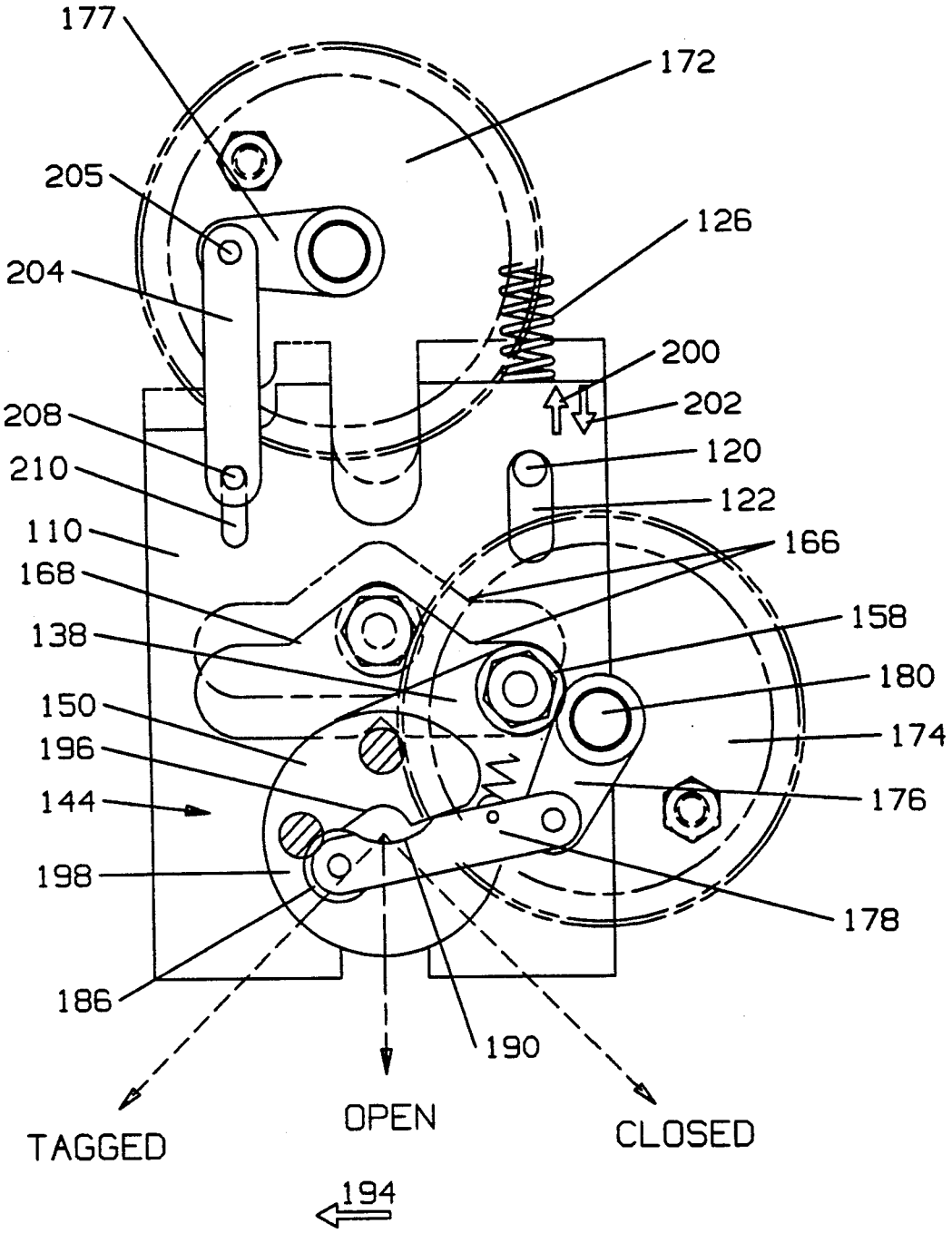
FIG. 11 is a cross sectional view of selected components taken through line 11—11 of FIG. 6.

Referring now to FIG. 11, remote, or electrically driven operation of relay 20 by way of solenoids 170, 172 and 174, crank members 142 and 144 and detent plate 110, is illustrated. A remote electrical signal received by relay 20 to execute a shift from the "open" to the "tagged" position results in actuation of "tagging" solenoid 174 (ghost illustration), which imparts a torque to solenoid drive arm 176, which in turn imparts a linear force to actuating member 178 in the direction indicated by arrow 194. Referring to FIG. 10*a*, such a force can be seen to shift actuating member 178 from a position in which roller 186 rests in a first ramp surface 196, to a position in which it rests in a second ramp surface position 198. With actuating member 178 so positioned, it can be seen that force in a direction 194 as indicated in FIG. 11 will impart a torque, via ramp 150 in crank member 144 to switch shaft construction 136 to rotate it clockwise, towards the "tagged" position. The relay may be designed and constructed such that such actuation of solenoid 174 would drive switch shaft construction clockwise completely to the "tagged" position. Alternately, and in the preferred embodiment, switch shaft construction 136 is driven, as described above, until cam follower 158 passes an intermediate rotary position at location 166 of detent cam surface 168, whereupon solenoid 174 is de energized (in a manner described below), whereupon spring 126, exerting a force in a downward direction indicated by arrow 202 on detent plate 110, results in a force applied to cam follower 158 by detent cam surface 168 to complete rotation of switch shaft construction 136 into the "tagged" position, and to hold said construction therein. With relay 20 in the "tagged" position (or in the "closed" position, not illustrated), it can be seen that "tagging" solenoid 174 or its mirror image counterpart "closing" solenoid 170, if actuated, would have no effect on switch shaft construction 136 through crank members 142 or 144.

With the relay 20 in the "tagged" or "closed" position, "opening" solenoid 172 may be actuated, for example by remote electrical signal, which actuation imparts a torque to solenoid drive arm 177, imparting an upward force on solenoid actuating member 204. Member 204 is slotted at its upper end (see FIG. 11) to form a yoke fitting over arm 177 and attached thereto by pin 205. At its lower end, member 204 is slotted to form a yoke and fits over detent plate 110. Pin 208 passes through lower end of member 204 and through slot 21 in detent plate 110 to complete the linkage between solenoid 172 and detent plate 110. When detent plate 110 is moved up or down by manual switching or actuation of "tagging" solenoid 174 or "closing" solenoid 170, actuating member 204 and drive ar 177 of "opening" solenoid 172 are unaffected as slot 210 slides up and down relative to pin 208, which remains stationary. However, when relay 20 is in the "tagged" position, as shown in FIG. 11, actuation of solenoid 172 imparts an upward force on detent plate 110, against the force of spring 126, through drive arm 177, actuating member 204, pin 208 and the upper end of slot 210. This force causes detent cam surface 168 to exert a force against cam follower 158, exerting a counterclockwise torque on switch shaft construction 136, through cam member 138 (viewed as in FIG. 11), toward the "open" position. As in the case of remote rotation of switch shaft construction 136 from the "open" position to either of the "tagged" or "closed" positions, rotation by way of "opening" solenoid 172 through associated linkage effects only partial rotation, as circuitry addressing solenoid 172 is designed so that solenoid 172 is de energized at an intermediate rotary position, as described above with respect to "tagging" solenoid 174. Specifically, when switch shaft construction 136 is driven from the "tagged" position to an intermediate rotary position at 166 toward the "open" position, solenoid 172 is de energized and the downward force of spring 126 drives detent plate 110 downward, in the direction of arrow 202, and detent cam surface 168 in detent plate 110 forces cam follower 158 toward the center, or "open" position driving switch shaft construction 136 to the "open" position. Although not illustrated, rotation from the "closed" position to the "open" position is similarly effected by the action of opening solenoid 172 and associated linkage in combination with detent plate 110 and the force of spring 126.

It can be seen that actuation of solenoid 172, when relay 20 is in the "tagged" or "closed" position will have the effect of rotating switch shaft construction 136 to the "open" position, as described above. It can also be seen that, when relay 20 is in the "open" position, actuation of solenoid 172 will have no effect on the position of switch shaft construction 136 and relay 20.

Figure 12:
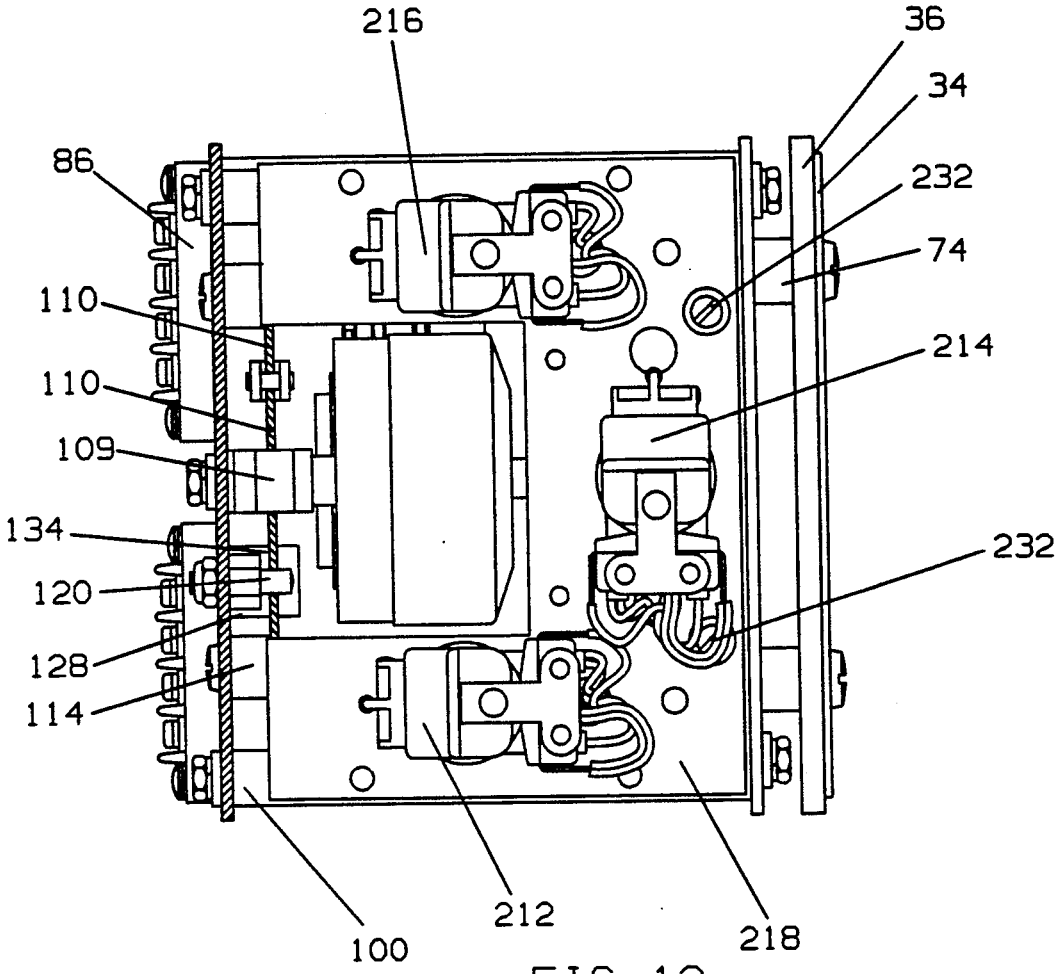
FIG. 12 is a cross-sectional view taken through line 12—12 of FIG. 6.

Referring now to FIG. 12, "closing" switching relay 212, "opening" switching relay 214, and "tagging" switching relay 216 are illustrated, mounted upon plate 218. Plate 218 may comprise any rigid, non-electrically conductive material, and comprises epoxy glass in a preferred embodiment. The switching relays may be attached to plate 218 using any conventional securing means, and in the preferred embodiment, are attached by way of screws 220 (FIG. 14) which thread directly into the bodies of the switching relays. The switching relays are closed by way of actuating circuitry described below and are held open by conventional coil springs 222 (FIG. 6). Any switching relay suitable in accordance with the electrical requirements of the relay of the preferred embodiment may be employed. Such relays are available, for example, as part number 188 KDX-91 available from Magnacraft, of Chicago, Ill. Detent plate mounting brackets 114 are not shown in FIG. 12.

Figure 13:
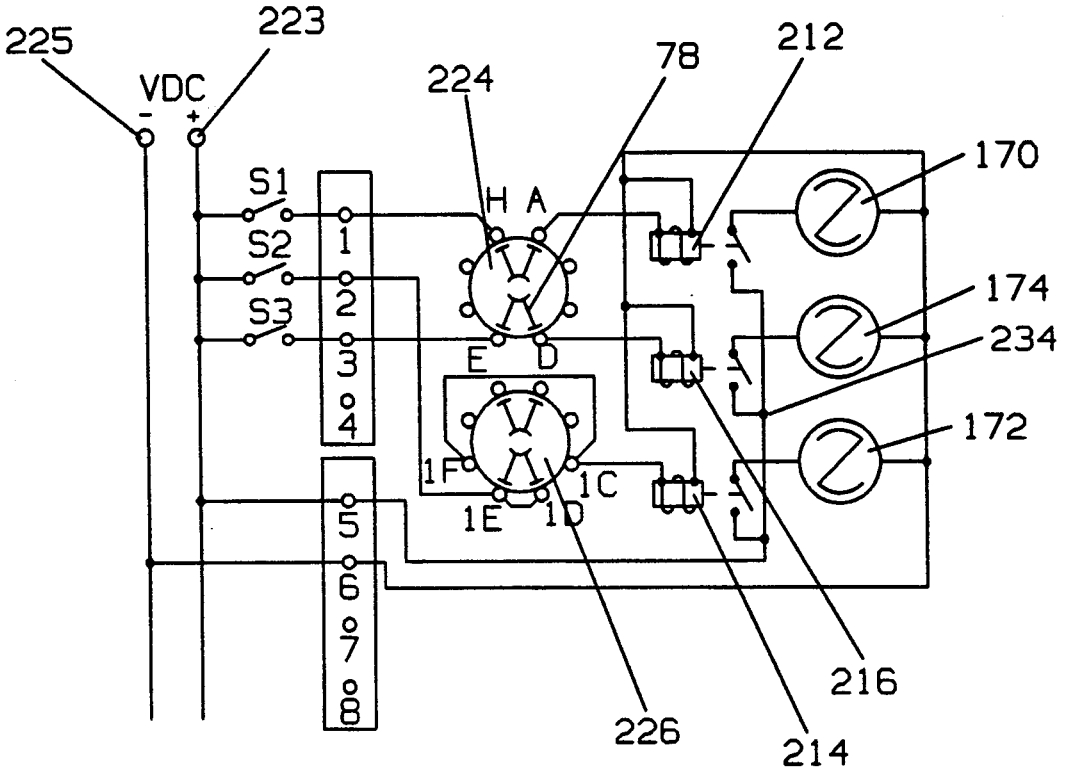
FIG. 13 is a semidiagrammatic circuit diagram of an exemplary control circuit in accordance with a preferred embodiment of the present invention.

Referring now to FIG. 13, a semidiagrammatic circuit representation is illustrated showing an exemplary preferred wiring diagram of the present invention, as an example of electrical, preferably remote, operation of the preferred relay of the invention. The preferred relay is designed to operate at between about 90 volts DC and about 125 volts DC, this voltage supplied by negative terminal 225 and positive terminal 223. FIG. 13 is drawn with the tagging relay in the "open" position (refer to FIG. 4). Remote operation of the relay from the "open" position to the "tagged" position is initiated by closing remote switch S3. This causes current to flow to terminal E of control deck 224, comprising a stage 76 of switch body 28, and flow through one of the movable electrical contact members 78 to terminal D and to "tagging" switching relay 216. In turn, "tagging" switching relay 216 closes its contact and energizes "tagging" solenoid 174. Solenoid 174 now drives the tagging relay clockwise toward the "tagged" position as described above. At the above-noted intermediate rotary position (approximately 30 degrees of rotation in the preferred embodiment) electrical contact E-D in control deck 224 is open circuited as it indexes through the position change. This causes "tagging" switching relay 216 to open its contact and de energize "tagging" solenoid 174. At this point detent action, by way of detent plate 110, spring 126, detent cam surface 168, and cam follower 158, as described above, takes over and drives the switch shaft construction an additional rotational distance (a additional 15 degrees in the preferred embodiment) to complete the rotation to the "tagged" position.

Remote operation of the relay from the "tagged" position to the "open" position is initiated by means of closing remote switch S2. This causes current to flow to terminal 1E of control deck 226. As the tagging relay is now in the "tagged" position (see FIG. 4), current will flow through another of the movable electrical contact members 78 to terminal 1F to "opening" switching relay 214. In turn, relay 214 closes its contacts and energizes "opening" solenoid 172. Solenoid 172 now pulls detent plate 110 in the direction of arrow 200, that is, upward in FIG. 11, indexing the tagging relay counterclockwise towards the "open" position, until control contact 1F-1E is open circuited (at approximately 30 degrees rotation in the preferred embodiment) at the above noted intermediate rotary position. At this point, "opening" switching relay 214 is de-energized and in turn de energizes "opening" solenoid 172 allowing the detent drive plate 110 and spring 126 to complete rotation to the "open" position, as described above. It can be seen that with the relay in the "closed" position, closing remote switch S2 will cause current to flow between contacts 1D and 1C of control deck 226, closing the "opening" switching relay 214 and actuating "opening" solenoid 172 to rotate the switch shaft construction 136 to the "open" position as described above. Additionally, it can be seen that closing remote switch S1, if the relay is in the "open" position, as illustrated in FIG. 13, will cause current to flow from contact H to contact A of control deck 224 activating "closing" switching relay 212, which in turn actuates "closing" solenoid 170 to rotate switch shaft construction 136 toward the "closed" position to an intermediate rotary position, at which point, as described above, closing solenoid 170 will be de activated and mechanical action via detent plate 110 and associated construction will take over, switching the relay to the "closed" position.

Figure 14:
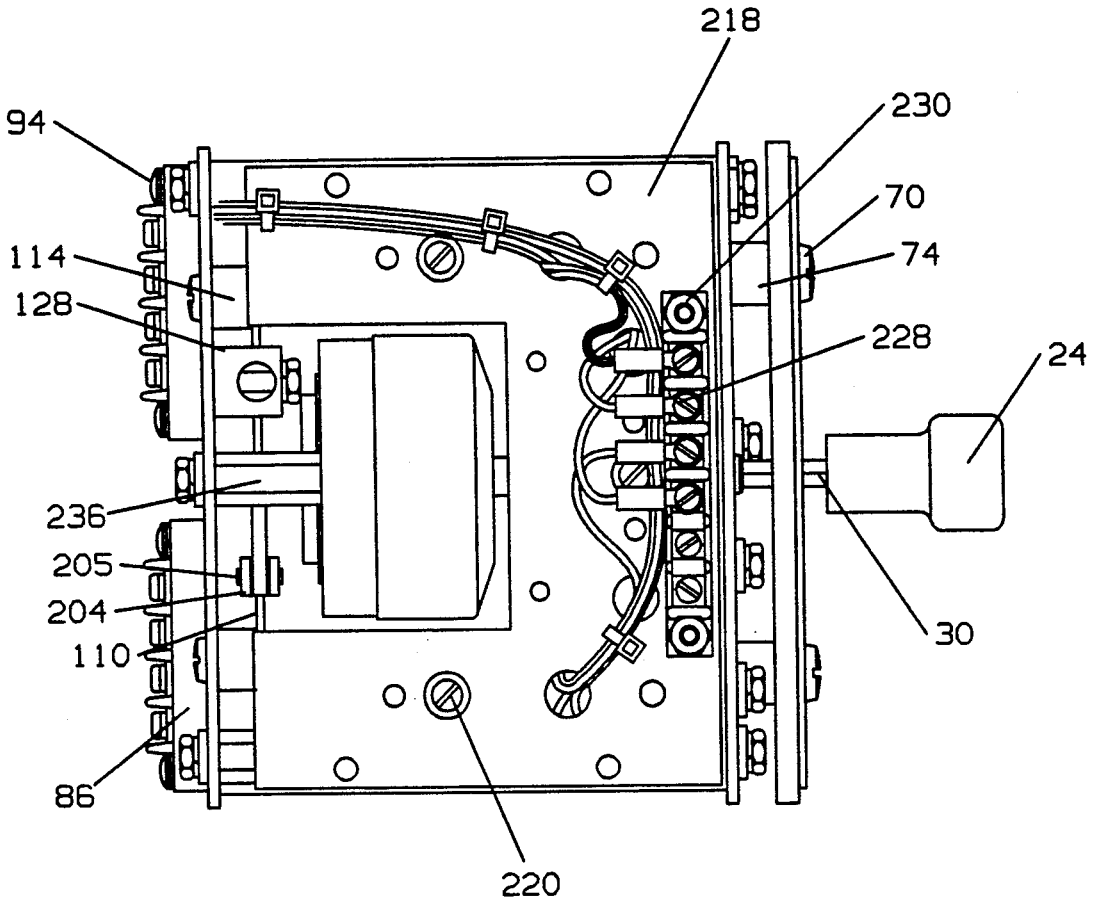
FIG. 14 is a cross-sectional view taken through line 14—14 of FIG. 6, absent illustration of members 100.

Referring now to FIG. 14, terminal block 228 is illustrated, mounted atop plate 218, opposite the switching relays. Terminal block 228 is fastened to plate 218 by nuts 230 and bolts 232 (FIG. 12). Terminal block 228 serves to interconnect circuitry represented in FIG. 13, for example at junction 234. Such wiring is common to one skilled in the art.

It is a feature of the present invention that a two position or three position tagging relay is provided comprising one or more solenoids, a switch shaft construction, a handle to manually actuate the switch shaft construction, and circuitry for receiving remote signals which actuate the solenoid(s). Thus, a two or three position tagging relay in which manual operation or remote operation may occur, either independently of the other, to facilitate remote operation of power lines, especially distribution lines from a central location such as SCADA is provided. Such remote and/or manual operation may be complemented by intense verbal and/o radio communication between central control, for example SCADA, and possible local manual actuating personnel.

It would be apparent to one skilled in the art, with reference to switch body 28 and the circuit diagram illustrated in FIG. 13, that tagging relay 20 may be wired so as to allow a variety of particular desirable combinations of remote switching functions. For example, relay 20 may be wired so as to allow remote switching from the "open" to the "tagged" position only, from the "open" to the "closed" position only, from the "closed" or "tagged" position to the "open" position only, or any combination thereof. It may be desirable to facilitate such wiring to comply with rules of power control associated with the power system addressed by the tagging relay.

It would also be apparent to one skilled in the art that the relay may be wired to allow a signal to emanate from switch body 28, the signal specific to the position of the tagging relay, that is, "closed", "open", or "tagged". Such a signal may actually energize or de-energize a breaker coil of a power line, or may signal a central control system such as SCADA that energizing or de-energizing a particular breaker coil or line may be allowable or un allowable based upon the rules of the particular power transmission system addressed.

While specific embodiments of the invention have been shown and described, it will be obvious that many variations are possible. For example, the specific size and construction materials employed in the tagging relay may vary as well as the physical arrangement, number, and actuating method of the solenoids. Additionally, a tagging relay comprising solenoids for solely remote actuation may be provided, or a tagging relay comprising only a manual actuating facility such as handle 24 in combination with tag assembly 22 may be provided. It is therefore to be understood that the foregoing description is by way of illustration only, and equivalents are understood to be within the scope of the present invention.

What is claimed is:

1. A method of opening and closing a power circuit through a tagging relay, said relay having a first position in which said power circuit is energized, a second position in which said power circuit is de energized and a third position in which said power circuit is de-energized and a tag is visibly in position to visually indicate the de-energized position of said tagging relay, said method comprising:

utilizing a shaft construction to move a rotary switch from said first to said second position or from said second position to said first position or said third position, or from said third position to said second position, said method further comprising selectively utilizing an electrical circuit to remotely operate said tagging relay to remotely move said tagging relay into any one of said first, second, or third positions.

2. A method in accordance with the method of claim 1, and further comprising:

manually actuating said shaft construction to any one of said first, second, or third positions.

3. A method in accordance with the method of claim 1 wherein said tagging relay is brought to said first position by a solenoid in said remote operation.

4. A method in accordance with the method of claim 1 wherein said tagging relay is brought to said second position by a solenoid in said remote operation.

5. A method in accordance with the method of claim 1 wherein said tagging relay is brought to said third position by a solenoid in said remote operation.

6. A method in accordance with the method of claim 1, wherein said tagging relay is brought to said first position from said second position by a first solenoid in said remote operation, said tagging relay is brought to said second position from said first position or from said third position by a second solenoid in said remote operation, and said tagging relay is brought to said third position from said second position by a third solenoid in said remote operation.

7. A method in accordance with the method of claim 1, in a system in which a individual power line can be controlled from a location near the line or from a location remote from the line, said method further comprising:

utilizing said shaft construction to move said rotary switch from said first to said second position and from said third position to said second position and from said second position to said first position or said third position, said first position allowing a line circuit breaker to be closed from said location near the line or from said location remote from the line, said second position allowing said line circuit breaker to be closed from said location near the line and preventing said line circuit breaker from being closed from said location remote from the line, and said third position preventing said line circuit breaker from being closed from any location.

8. A method in accordance with the method of claim 7, said method further comprising:

manually actuating said shaft to any one of said first, second, or third positions.

9. A tagging relay for a power circuit comprising.

first, second and third solenoids constructed and arranged to actuate rotary movement of a switch shaft construction to first, second and third positions, respectively, said solenoids each having an actuating member operably linked to cause rotary movement of said switch shaft construction by means of a detent construction, said detent construction carrying a cam arrangement for locking said switch shaft construction in said first, second or third positions while permitting reciprocal rotation of said switch shaft construction to said first, second or third positions by operation of at least one of said solenoids.

10. A tagging relay in accordance with claim 9 and further comprising an operating handle, said operating handle being linked to said switch shaft so as to allow said switch shaft to be moved to said first, second or third position by manual operation of said operating handle.

11. A tagging relay in accordance with claim 9, said solenoids being rotary solenoids, and said first and second actuating members being constructed and arranged to transfer a rotary solenoid torque through a force applied by a linear actuating member to a rotary switch shaft construction to obtain a torque output of said switch shaft construction.

12. A tagging relay in accordance with claim 9, and further comprising at least one electrical output assembly operably linked to said switch shaft construction, said at least one output assembly being constructed and arranged to transmit an electrical signal when said switch shaft construction is in one of said first, second, or third rotary positions.

13. A tagging relay in accordance with claim 9 and further comprising at least one control electrical circuit, said control circuit being linked to said switch shaft construction and being linked to a remote signal input so as to allow said switch shaft to be moved to said first, second, or third position by remote operation of said control circuit.

14. A tagging relay in accordance with claim 10, and further comprising:

said tagging relay having an exposed face, and a tag linked to said switch shaft construction, said tag being visible to the eye of a user at said face, when said switch shaft construction is in said third position.

15. A tagging relay in accordance with claim 10 and further comprising, a first and a second crank member operably linked to said switch shaft construction, said first and second crank members each having first and second solenoid actuating member receiving surfaces for receiving solenoid actuating members operably linked to said first and said second solenoids, respectively, said second receiving surface of said first crank member being engaged by said actuating member operably linked to said first solenoid during operation of said first solenoid so as to allow said first solenoid to impart a torque to said switch shaft construction to rotate said switch shaft construction to said first position, and said second receiving surface of said second crank member being engaged by said actuating member operably linked to said third solenoid during operation of said third solenoid so as to allow said third solenoid to impart a torque to said switch shaft construction to rotate said switch shaft construction to said third position.

16. A tagging relay in accordance with claim 10, and further comprising:

at least one crank member operably linked to said switch shaft construction, said crank member having a first solenoid actuating member receiving surface engaged by a solenoid actuating member when said first solenoid is inoperative, and a second solenoid actuating member receiving surface engaged by said solenoid actuating member during operation of said solenoid so as to allow said solenoids to impart a torque to said switch shaft construction to rotate said switch shaft construction to said first or to said third position.

17. A tagging relay in accordance with claim 16 wherein said detent construction comprises a detent plate carrying said cam arrangement, said detent plate and cam arrangement permitting said first solenoid to move said switch shaft construction to a first rotary position corresponding to a closed position of said power circuit, said detent plate and cam arrangement permitting said second solenoid to move said switch shaft construction to a second position corresponding to an open position of said power circuit, said detent plate and cam arrangement permitting said third solenoid to move said switch shaft construction to a third rotary position corresponding to a tagged position of said power circuit, said detent plate and cam arrangement preventing said first or said third solenoid from moving said switch shaft construction to said first or said third positions, respectively, unless said switch shaft construction has been brought to said second position by said second solenoid, said detent plate and cam arrangement further preventing said switch shaft construction from moving from any of said first, second, or third positions to any other of said positions in said remote operation in the absence of solenoid operation.

18. A tagging relay in accordance with a claim 17, said cam arrangement being attached to said switch shaft construction and engaged by said detent plate, and said detent plate being attached to a resilient member and being constructed and arranged such that said first or said third solenoid, when operative, causes said cam arrangement to displace said detent plate so as to impart a force against said resilient member until said switch shaft construction reaches a first or a second intermediate rotary position, respectively, whereupon said resilient member imparts a force against said detent plate causing said cam arrangement to rotate said switch shaft construction to said first or said third position, respectively.

19. A tagging relay in accordance with claim 17, said cam arrangement being attached to said switch shaft construction and engaged by said detent plate, and said detent plate being attached to a resilient member and being constructed and arranged such that said second solenoid, when operative, causes said cam arrangement to displace said detent plate so as to impart a force against said resilient member until said switch shaft construction rotates from said first position to said first intermediate rotary position, or from said third position to said second intermediate rotary position, whereupon said resilient member imparts a force against said detent plate causing said cam arrangement to rotate said switch shaft construction to said second position.

20. A tagging relay in accordance with claim 14, said control circuit comprising:

a contact carrying rotary switch shaft operably linked to said switch shaft construction and comprising a plurality of electrical control contacts, said contact carrying assembly being designed and constructed to receive a first input signal from at least one remote location, which first signal activates said first solenoid to rotate said switch shaft construction from said second position toward said first position to at least a first intermediate rotary position, said contact carrying assembly being further designed and constructed to receive a second input signal from at least one remote location, which second signal activates said second solenoid to rotate said switch shaft construction from said first position or from said third position toward said second position to at least said first intermediate rotary position or to at least a second intermediate rotary position, respectively, said contact carrying assembly being further designed and constructed to receive a third input signal from at least one remote location, which third signal activates said third solenoid to rotate said switch shaft construction from said second position toward said third position to at least said second intermediate rotary position, said contact carrying assembly being still further designed and constructed to prevent actuation of said first, second, or third solenoid when said switch shaft construction is in any other than said second, first or third, or second position, respectively.

21. A tagging relay in accordance with claim 14, said relay further comprising first, second, and third electrical output signal assemblies, said first assembly being constructed and arranged to deliver a first output signal when said switch shaft construction is in said first position, said second assembly being constructed and arranged to deliver a second output signal when said switch shaft construction is in said second position, and said third output assembly being constructed and arranged to deliver a third output signal when said switch shaft construction is in said third position.

22. A tagging relay in accordance with claim 21, said first output signal allowing a power line circuit breaker to be closed from a location near the line or from a location remote from the line, said second output signal allowing said line circuit breaker to be closed from said location near the line and preventing said power line circuit breaker from being closed from said location remote from the line, and said third output signal preventing said line circuit breaker from being closed from any location.

23. A tagging relay in accordance with claim 21, said relay being constructed and arranged such that when said switch shaft construction is in said first position a power circuit linked to said relay is energized, when said switch shaft construction is in said second position said power circuit is de-energized, and when said switch shaft construction is in said third position said power circuit is de-energized and a tag is visibly in position to visually indicate the de energized state of said tagging relay.

24. A tagging relay in accordance with claim 21, wherein said first, second, and third electrical output signal assemblies comprise a contact carrying rotary switch shaft and a plurality of stationery electrical contacts, which contact carrying shaft is operably linked to said switch shaft construction.

25. A method of opening and closing a power circuit through a tagging relay, said relay having a first position in which said power circuit is energized, an alternate position in which said power circuit is de energized and a tag carrying a written message is visibly in position to visually indicate to a user the de energized position of said tagging relay, said method comprising:

utilizing a shaft construction to move a rotary switch from a first to said alternate position o from said alternate position to said first position by means of a plurality of rotary solenoids, said method further comprising selectively utilizing either an electrical circuit to remotely operate said tagging relay to remotely move said relay into said first or said alternate position or manually actuating said shaft construction to said first or said alternate position.

26. A tagging relay for a power circuit comprising, first and second rotary solenoids constructed and arranged to actuate rotary movement of a switch shaft construction to a first and second position, respectively, each solenoid having an actuating member operably linked to cause rotary movement of said switch shaft construction through a detent construction, said detent construction carrying a cam arrangement for locking said switch shaft construction in said first or alternate position while permitting reciprocal rotation of said switch shaft construction to said first or alternate position by operation of at least one of said solenoids, said tagging relay further carrying an operating handle for operating said switch shaft construction to said first or said alternate position, and at least one of said positions being indicated by a tag carrying a verbal message which tag is operably linked to said shaft construction for rotation therewith into and out of a visible position.

27. A tag assembly for use with an electrical power line switch to indicate a tag member position wherein a power line is opened and a second position wherein said power line is energized, said assembly comprising, a front wall and a rear wall mounted substantially parallel to each other defining a space therebetween, a switch shaft mounted for rotation and passing substantially perpendicular to said first and second walls, a substantially planar tag assembly linked to said shaft for rotary movement therewith and carrying a tag member, said tag member comprising a visible message and being spring biased against said front and rear walls to allow rotation therebetween, said front wall defining an opening through which said visible message is visible in a first position of said rotary shaft and tag member, said tag assembly defining an abutment surface, at least one of said walls mounting a stationary detent means positioned and arranged to act as a resilient, cushioning stop for said tag assembly and provide presentation of said tag member to said opening in said front wall at a predetermined location consistent with optimum viewing in a correct position.

* * * * *